US005339905A

United States Patent [19]

Dowker

[11] Patent Number: 5,339,905

[45] Date of Patent: Aug. 23, 1994

[54] GAS INJECTION DEWATERING PROCESS AND APPARATUS

[75] Inventor: Clark A. Dowker, Johannesburg, Mich.

[73] Assignee: Subzone Lift Systems, Johannesburg, Mich.

[21] Appl. No.: 981,503

[22] Filed: Nov. 25, 1992

[51] Int. Cl.[5] ..... E21B 43/12

[52] U.S. Cl. ..... 166/369; 166/324

[58] Field of Search ..... 166/263, 311, 369, 372, 166/373, 374, 324

[56] References Cited

U.S. PATENT DOCUMENTS

| | | | |
|---|---|---|---|
| 404,397 | 6/1889 | Geiser . | |
| 1,153,373 | 1/1915 | Deemer . | |
| 1,374,952 | 4/1921 | Rogers . | |
| 3,334,690 | 8/1967 | Garrett | 166/46 |
| 3,580,336 | 5/1971 | Meldau | 166/267 |
| 4,014,387 | 3/1977 | Fink | 166/369 |
| 4,040,486 | 8/1977 | Kirkland, Jr. | 166/311 |
| 4,243,102 | 1/1981 | Elfarr | 166/314 |
| 4,267,885 | 5/1981 | Sanderford | 166/250 |
| 4,544,037 | 10/1985 | Terry | 166/369 |
| 4,579,511 | 4/1986 | Burns | 417/109 |
| 4,596,516 | 6/1986 | Scott et al. | 417/58 |
| 4,708,595 | 11/1987 | Maloney et al. | 417/109 |
| 4,756,367 | 7/1988 | Puri et al. | 166/263 |
| 4,787,450 | 11/1988 | Andersen et al. | 166/167 |
| 4,791,990 | 12/1988 | Amani | 166/311 |
| 4,901,798 | 2/1990 | Amani | 166/311 |
| 5,033,550 | 7/1991 | Johnson et al. | 166/372 |

OTHER PUBLICATIONS

"The Technology of Aritficial Lift Methods", vol. 22, pp. 95–100, Petroleum Publishing Co., 1980.

*Primary Examiner*—Ramon S. Britts
*Assistant Examiner*—Frank S. Tsay
*Attorney, Agent, or Firm*—Price, Heneveld, Cooper, DeWitt & Litton

[57] ABSTRACT

An improved method is provided for producing natural gas from wells where gas production has been hampered by the infiltration of water which had heretofore been deemed too expensive to remove when compared to the amount of gas produced from the well. The method includes lowering a conduit from the surface into the well to a depth the water level is to be lowered. Water in the well is allowed to flow into the conduit in a single direction only. A volume of refined natural gas is injected into the conduit below the water contained therein. The injected gas expands within the conduit lifting the volume of water to the surface. Water removed from the well is transported with the injected gas to a storage and processing facility. Lowering of the water level in the well reduces the hydrostatic pressure exerted upon the gas producing horizon to allow gas to flow into the well. Produced gas is transported along with the water and injected gas. This method and an apparatus for use in carrying out the method may also be used in newly drilled gas wells.

25 Claims, 4 Drawing Sheets

GAS INJECTION DEWATERING PROCESS AND APPARATUS

BACKGROUND OF THE INVENTION

The present invention relates to a method and apparatus for producing oil and gas, and particularly to a method and apparatus for efficiently and effectively removing cormate or interstitial water from oil and gas wells.

Oil and gas are produced from wells penetrating subsurface hydrocarbon-bearing formations or reservoirs. Such reservoirs can be found at various depths in the earth's subsurface. In gas-producing reservoirs, the gas contained therein is compressed by the weight of the overlying earth. When the formation is breached by a well, the gas tends to flow into the well under formation pressure. Any other fluid in the formation, such as connate water trapped in the interstices of the sediments at the time the formation was deposited, also moves toward the well. Production of the fluids is maintained as long as the pressure in the well is less than the formation pressure. Eventually production ceases either because formation pressure equals or exceeds bore hole pressure. In the latter case, it has often been found that cormate or interstitial water filling the well exerts sufficient pressure to stop or sharply reduce production. A problem arises when the expense of removing the water becomes a substantial portion of, or exceeds the value of the hydrocarbon produced.

Several kinds of lift or pumping devices have been used to extract fluids from wells. Piston pumps are common and require either an electric or gas powered motor which is coupled by belts or gears to a reciprocating pump jack. The reciprocating motion of the pump jack, in turn, reciprocates a piston within a cylinder disposed within the well. As the piston reciprocates within the well, valves open and close, creating a low pressure in the well and drawing the oil to the surface. Centrifugal or rotary pumps, often found in water wells, also operate by either an electric or gas powered motor. Usually, the pump is attached directly to the shaft of the motor. The rotary motion of the veins creates a low pressure in the well, thereby causing the fluid to flow up the well.

A major disadvantage with both piston and centrifugal pumps is the mechanical fatigue and failure of moving parts which require continual maintenance and repair. Furthermore, such systems are consumers of energy, that is, they use electricity or burn fuel costing many times more to run than passive systems. Typically, the expense of maintaining and operating such systems will eventually exceed the economic benefits returned.

In the singular case of oil wells, gas-lift systems have been used wherein gas from the well, an air compressor, or other source of gas is injected down the well through a pipe coupled to a second pipe having an end immersed in the oil. The injection of a volume of gas below a volume of oil in the pipe lifts the oil to the surface. Gas-lift systems, which use an air compressor or other mechanical device located at the well site to inject the gas, also require periodic service and maintenance and thus suffer the same disadvantages as the mechanical pumps described above. Gas-lift systems which use the gas produced from the well are expensive and difficult to install since the gas producing formation must be physically separated from the oil producing formation by at least one packing device. Such systems are typically permanent and are expensive to remove or service. Moreover, systems using formation gas are only effective so long as gas is being produced from the well; otherwise, an external source of gas is necessary. Lastly, many of the gas-lift systems corrode because they are made from materials unsuitable for the well environment. This is undesirable and can eventually lead to failure of the complete system.

Because of the ever increasing cost associated with the production of hydrocarbon resources, there has been, and continues to be a long-felt need for a low maintenance gas-lift assembly to more fully develop hydrocarbon resources. Moreover, such a device should be able to operate at a fraction of the cost of previous systems.

SUMMARY OF THE INVENTION

One novel aspect of the invention is to provide an inexpensive method for dewatering a gas well in order to stimulate gas production. The dewatering method includes the unique steps of lowering the water level in the well by locating the lower end of a dewatering conduit below the water level in the well, and placing the upper end in fluid communication with a water exhaust line at the surface. Water in the well is allowed to flow in a single direction into the lower end of the conduit, and is prevented from flowing back out through the lower end by a check valve or other similar device. Periodically, a volume of dried, pressurized natural gas is injected into the lower end of the conduit from a gas line and allowed to expand, thereby forcing a slug or column of water upwardly through the conduit toward the upper end coupled to the water exhaust. The steps are repeated to lower the water in the well to a predetermined point, thereby allowing the gas to flow more freely from the horizon and into the well. The gas in the well is captured in a conventional manner and transmitted with the gas-lifted water to a storage and processing facility.

Another unique aspect of the invention is to provide a corrosion resistant gas-lift assembly to remove the water from the gas well. The lift assembly includes a lightweight and corrosion free conduit having an upper end coupled to a water exhaust line and a lower end disposed in the well and submersed in the water. A generally parallel injection assembly has a first end in fluid communication with a source of pressurized and dried natural gas and a second end in fluid communication with the second end of the conduit in the water. In a preferred embodiment, a new and unique bushing couples the source of natural gas to the injection assembly. An inlet assembly is coupled to the conduit below the injection assembly to allow water in the well to flow in a single direction into the conduit. The assembly provides a system for transmitting the ejected water, the injected natural gas and the production gas to a storage and production facility where the water and gas are separated. Appropriate check valves are located in the assembly to prevent the water from reentering the well.

The principal objects of the novel method and unique apparatus are to provide an inexpensive way of removing water from a gas well to maximize gas production. The unique method and apparatus also provide a relatively maintenance free system for removing water when contrasted with continuously operating mechanical pumping systems. As a result, the extraction of the water using the lift assembly results in improved gas production with fewer maintenance costs, and a rapid payoff of the lift assembly. The corrosion resistant construction of the lift assembly substantially extends the life expectancy of the tool over that of the prior apparatus.

These and other objects, advantages, purposes and features of the invention will become more apparent from a study of the following description taken in conjunction with the drawing figures described below.

DETAILED DESCRIPTION OF THE PREFERRED EMBODIMENTS

Figure 2:
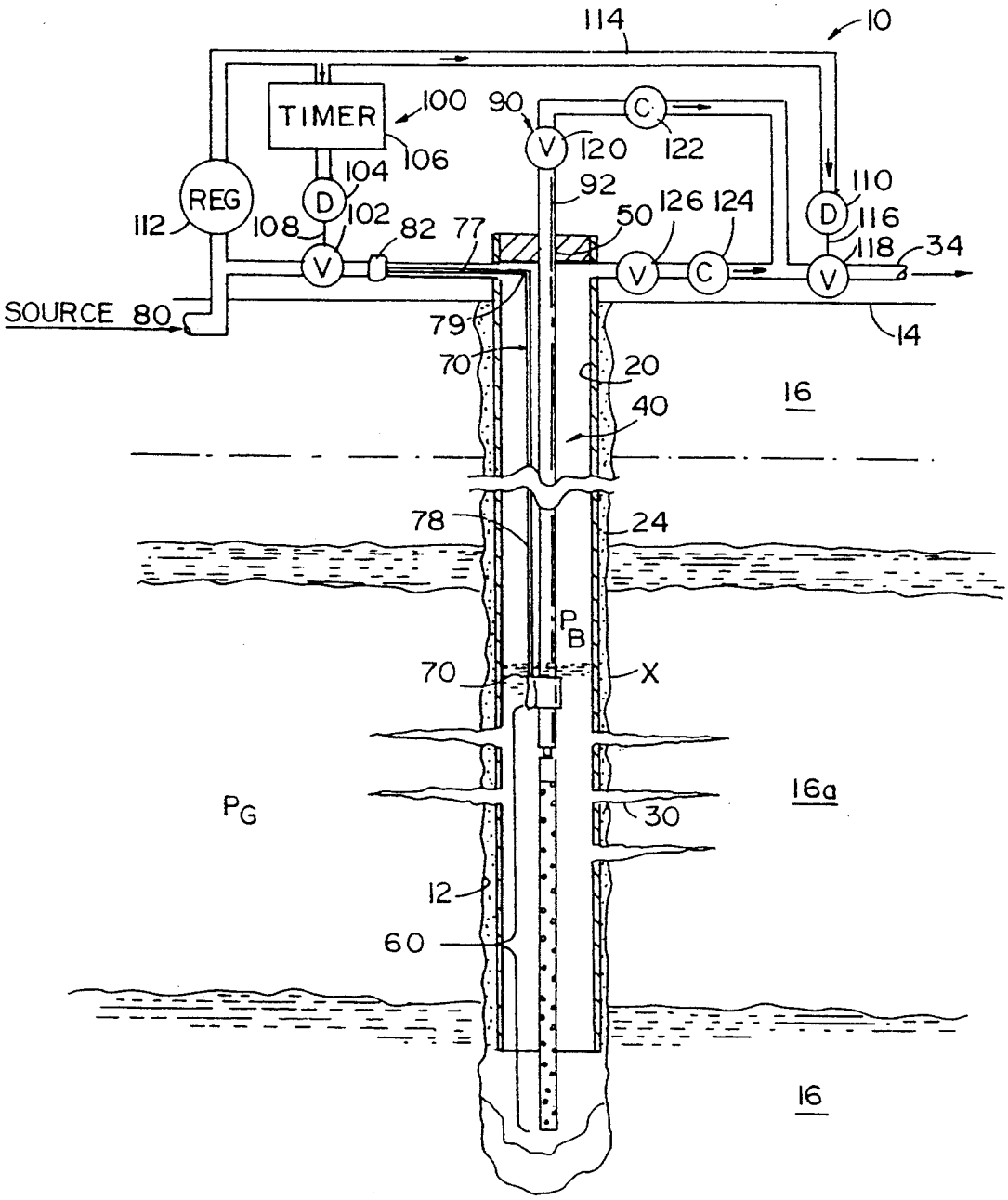
FIG. 2 is a schematic illustration of a new method and unique apparatus embodying the present invention.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The exploration and production of a natural resource is directly dependent upon the market price for the resource. When the market price is low, production too expensive to operate is temporarily stopped. This invention provides a unique method and improved apparatus for improving the production of gas from wells. In particular, the method and apparatus are most effective for wells where production has been hampered because of connate water migrating into the well bore.

For the purpose of the following discussion, the terms "gas," "natural gas, and "injected gas" shall refer to gas which is of the same species as the gas being produced from the well. For example, if the produced gas is methane, the "natural gas" or "injected gas" preferably would also be methane.

Figure 1:
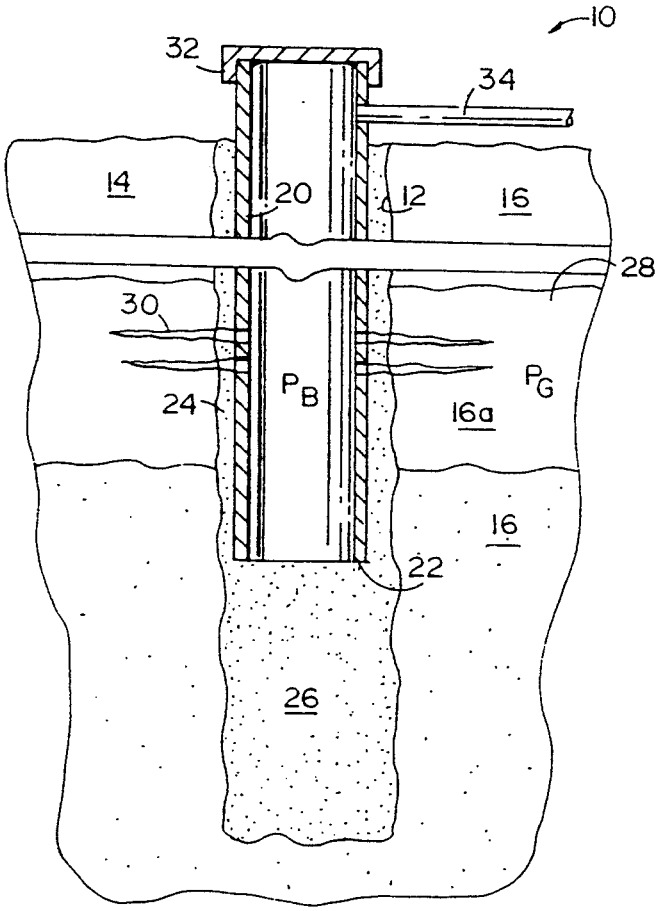
FIG. 1 is a schematic illustration of a water-filled gas well.

Referring now to the drawing figures, FIG. 1 is a schematic diagram of a gas well 10 shown in vertical section through the earth. Well 10 includes a bore hole 12 which extends downwardly from the earth's surface 14 to a predetermined depth. Bore hole 12 intersects and penetrates several, and often hundreds of subsurface horizons or formations 16. Well 10 typically includes a casing 20 which extends from surface 14 downwardly to a predetermined point 22 below the formation containing the hydrocarbon deposit such as indicated by 16*a*. Casing 20 is fixed within bore hole 12 by concrete 24 essentially sealing off formation 16*a* from the other formations penetrated by well 10. Portion 26 of bore hole 12 below casing 20 is typically sealed by concrete.

Hydrocarbons and cormate water (brine) are typically found in porous and permeable formations such as 16*a*. The hydrocarbons are often trapped within formation 16*a* by an impermeable cap layer such as 28. Because of the immense weight of the overlying strata, gas contained within reservoir 16*a* is compressed to a pressure $P_G$. The pressure $P_B$ within the bore hole is substantially lower. To access the gas contained in reservoir 16*a*, casing 20, concrete 24, and a portion of formation 16*a* are breached by explosive charges lowered in the well, forming perforations 30. The gas present within formation 16*a* at pressure $P_G$ then flows through perforations 30 to the lower pressure $P_B$ present in bore hole 12. The gas flows up the bore hole and is collected at the top of well 10 through a well-known well head 32 and transported to a storage and processing facility through a pipe 34.

If reservoir 16*a* contains cormate water, it will flow into bore hole 12 along with the gas. If the level of the connate water in bore hole 12 is sufficiently high, raising bore hole pressure $P_B$ to a point greater than formation pressure $P_G$, gas production may be reduced or even stopped. This is particularly true in older gas wells in their later stages of production.

Referring to FIG. 2, one embodiment of the method for removing cormate or formation water from well 10 includes locating an improved dewatering assembly 40 therein at a depth to reduce the water level so that the hydrostatic pressure $P_B$ on the gas bearing formation is less than the formation pressure $P_G$ exerted by the gas. Water is removed from the well by locating assembly 50 in the well to extend from surface 14 to a point X in the well where the water level is to be lowered. Formation water in the well is allowed to flow into assembly 50 through an inlet assembly 60 in fluid communication with the bottom of assembly 50. The level of the water flowing through inlet assembly 60 into assembly 50 will equalize with the water level in bore hole 12. A charge of pressurized and dried gas, preferably of the same species as produced from well 10, is injected into assembly 50 just above inlet assembly 60 by a unique injection assembly 70 in fluid communication with a source 80 at surface 14. The gas charge injected into assembly 50 expands therein and creates a lower pressure in assembly 50, raising the column of water to surface 14. A novel exhaust assembly 90, in fluid communication with the upper end of assembly 50, directs the exhausted water to a disposal facility. This process is repeated to lower the water level in well 10. Lowering of the water level results in a decrease in the hydrostatic pressure exerted by the water upon reservoir 16*a* so that gas may be produced. The gas produced from reservoir 16*a* is passed through production line 34 to a processing and storage facility.

In a preferred embodiment of the method, the exhausted slug of water and injected volume of gas are directed to transmission pipe 34 where they are combined with the gas produced from the well. The water is separated from the gas at the processing facility for later disposal. The injected gas and produced gas are mixed together during processing for later introduction into the gas transmission line.

Figure 3:
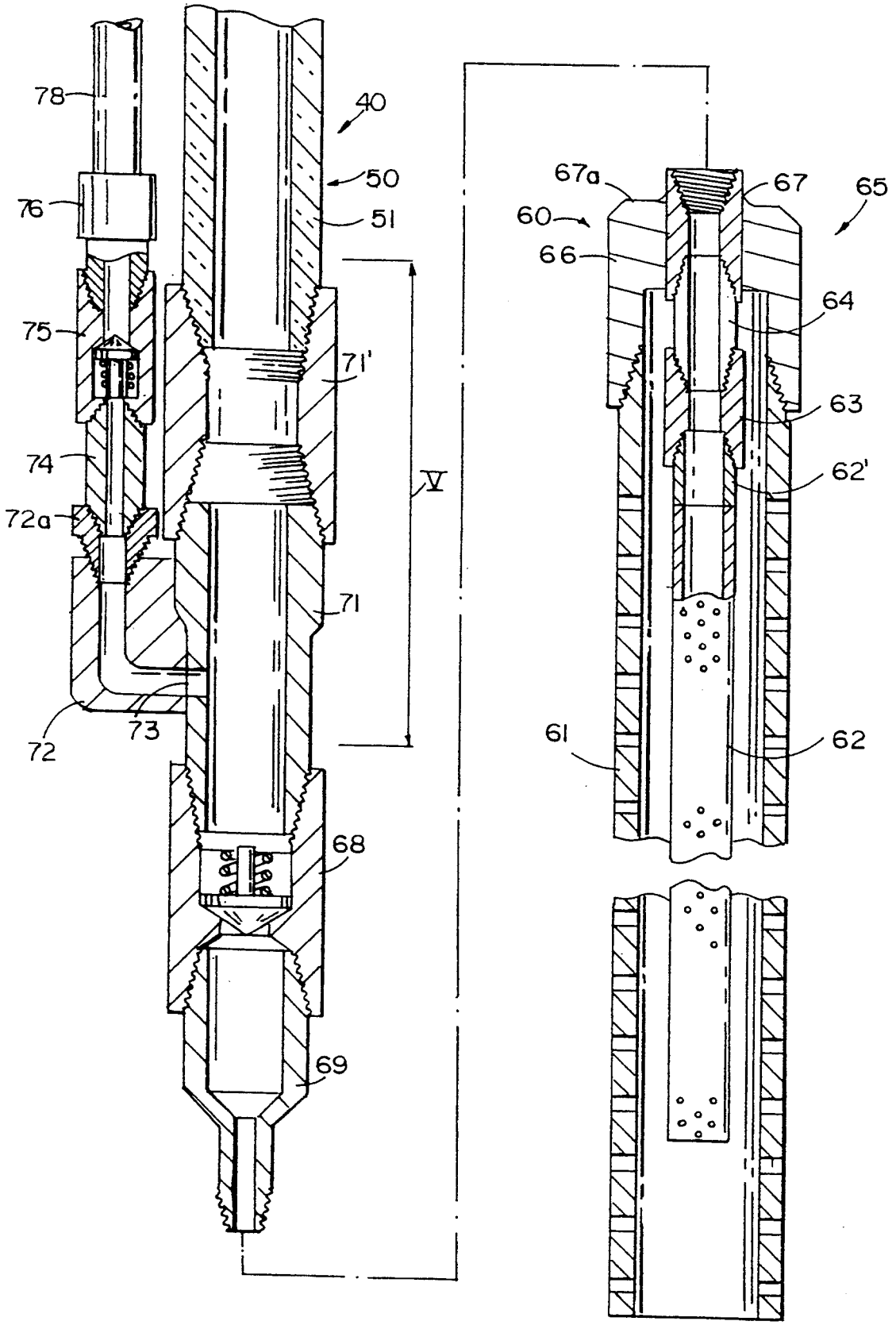
FIG. 3 is a longitudinal section view of one embodiment of an apparatus used in the method.

FIG. 3 is a longitudinal cross section view of a preferred embodiment of unique dewatering assembly 40 used in the above method. Beginning at the bottom of inventive assembly 40, inlet assembly 60 includes an outer perforated shield 61 which is preferably manufactured from 304 two-inch nominal stainless steel pipe having an outside diameter of two and three-eighths inches and threaded at one end. Shield 61 is perforated along its length to allow water to flow therethrough and concentrically encloses a 60 mesh screen 62 made from 316 stainless steel. It is preferred that screen 62 be cylindrical in form having a closed lower end and an upper end attached to a threaded nipple 62' coupled to a one-inch collar 63. Collar 63 has its opposite end threaded to a one-inch nipple 64, also made from 316 stainless steel. Both nipple 64 and shield 61 are coupled together by a unique coupler 65 which includes a two-inch tapered collar with chamfered corners 66 adapted to threadably receive the threaded end of shield 61. Concentrically disposed in coupling 66 and welded thereto is a one-inch collar 67 adapted to threadably receive nipple 64. Inlet assembly 60 further includes a check valve 68 coupled to the top of coupler 65 by a one-inch by one and one-half inch 316 stainless steel swage 69. Preferably, check valve 68 is a glass filled, Teflon check valve having a 400-pound working pressure, such as Model Number 62-107 produced by Conbraco Industries, Inc. of Pageland, S.C.

Lift assembly 50 is interconnected to the outlet end of check valve 68 by a swage 71 and collar 71'. It is preferred that swage 71 be a one and one-half NPT by one and one-half EUE ten round threaded swage to provide the transition from check valve 68 to lift assembly 50. Assembly 50 extends from swage 71 up to exhaust assembly 90 at the top of the well and in fluid communication with transmission pipe 34 (FIG. 2). It is preferred that assembly 50 include a lift pipe 51 made from interconnected lengths of one and one-half inch fiberglass tubing having a 0.130 inch wall thickness and a 1500 pound working pressure. At the top of bore hole 10, the interconnected sections of lift pipe 51 are coupled to pipe 92 of exhaust assembly 90, extending through well head 32, and in fluid communication with transmission pipe 34. The lengths of fiberglass pipe are interconnected by expanded upset end (EUE) threads typically found in well tools. Such threads are capable of withstanding tensional forces on the order of several thousand pounds.

Figure 4:
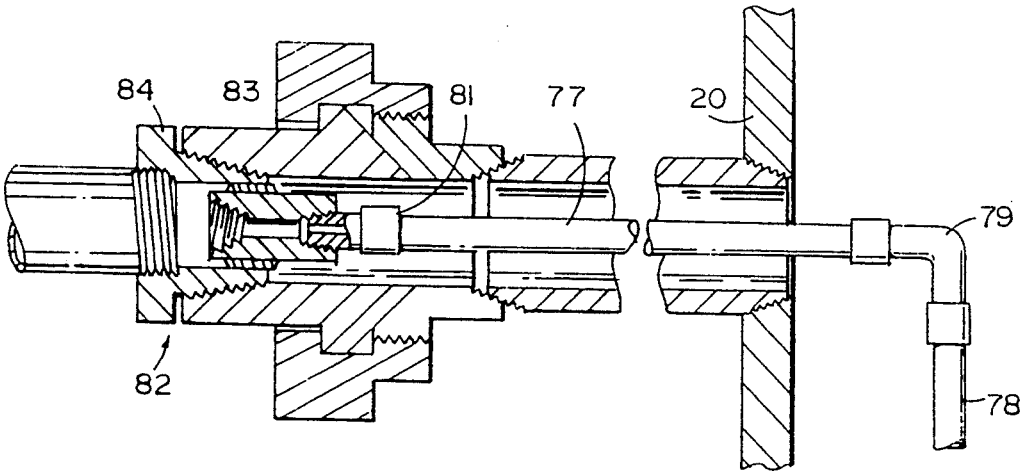
FIG. 4 is a fragmentary section view of the injection assembly in the well head.

Paralleling lift assembly 50 is injection assembly 70 which includes, at its lower end, an injection inlet 72 made from a one-half inch stainless steel street-L having one end welded to the outer surface of swage 71. A hole 73 drilled through the wall of swage 71 provides fluid communication between inlet 72 and swage 71. It is preferred that the end of inlet 72 be milled to form a saddle which conforms to the outer circumference of swage 71. Inlet 72 also has an adjacent surface machined in order to minimize the width of assembly 40 at this particular location to allow assembly 40 to pass longitudinally through well casings as small as four and one-sixteenth inches. Inlet 72 has an opposite end preferably fitted with a one-half inch by three-eighths inch 316 stainless steel bushing **72*a*. Bushing 72*a* is threadably coupled to a three-eighths inch, XH-nipple 74 which, in turn, receives check valve 75 at its opposite end such as Model Number 6F-C6L-15S (F2) produced by Parker Hannisin Corp. of Huntsville, Ala. Check valve 75 is coupled by a stainless steel three-eighths inch NPT by one-half inch compression connector 76 to a one-half inch nylon tubing 78. Tubing 78, specially selected for this application, preferably has a 500-pound working pressure and is available from Imperial Eastman Corp. of Manitowoc, Wisc. Tubing 78 is preferably fastened at intervals to lift tube 51 by pipeline tape or other fastener to keep the two in close proximity to each other. Injection tubing 78 extends toward surface 12 (FIG. 4) and is coupled to a 90 degree compression coupler 79 which, in turn, is coupled by a second length of tubing 77 to a second compression coupler 81 threaded to a unique coupler 82 in casing 20. Coupler 82 is unique in this application in that it preferably includes a one-half inch, 3000-pound working pressure collar 83 welded to the inside of a one-inch NPT by two-inch NPT forged steel bushing 84. Collar 83 is threaded at one end to receive one-half inch straight stainless steel compression connector 81 to attach tubing 77 to coupler 82**.

At the top of well 10 seen in FIG. 2, injection assembly 70 is controlled by a timing assembly 100 which controls the amount of gas provided by source 80. Timing assembly 100 includes a valve 102 which controls the flow of gas from source 80 into coupler 82 of injection assembly 70. Valve 102 is controlled by a diaphragm 104 in gaseous fluid communication with source 80 through timer 106. A mechanical linkage 108 interconnects valve 102 with diaphragm 104. Source 80 is also in gaseous fluid communication with diaphragm 110 through pipe 114 and regulator 112. Diaphragm 110 is mechanically coupled by linkage 116 to valve 118 in transmission pipe 34.

Figure 5:
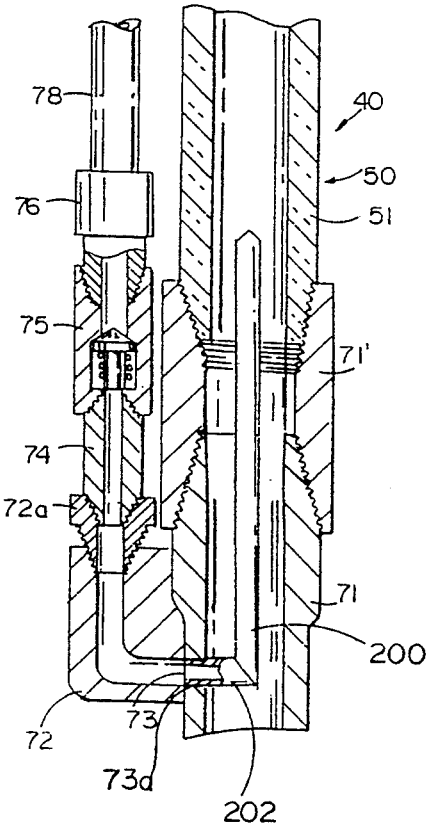
FIG. 5 is a fragmentary section view illustrating an alternate embodiment of the injection assembly.

FIG. 5 is a fragmentary section view of an alternate embodiment of a portion of injection assembly 70. This particular embodiment is preferably used in newly producing or young gas wells wherein formation or connate water from the reservoir tends to fill the well. Shown in section view is swage **71*a* used to interconnect lift pipe 51 and check valve 68 described above. Swage 71*a* is substantially identical to swage 71 described earlier. Disposed within swage 71*a* and oriented along the centerline is a length of one-half inch O.D. stainless steel tubing 200 having a wall thickness of 0.035 inch. A lower end 202 of tube 200 is oriented 90 degrees thereto and in fluid communication through hole 73*a* with stainless steel street-L 72*a* welded to the exterior of swage 71*a*. The 90 degree angle at end 202 of tubing 200 may be formed by mitering and welding two sections of tubing together. It is preferred that the portion of tube 200 extending into hole 73*a* be fixed therein by silver solder or the like. In this embodiment, gas injected into swage 71*a* is allowed to expand from the center of the swage and thus lift a larger slug of water than a bubble entering from the side through hole 73**.

Figure 6:
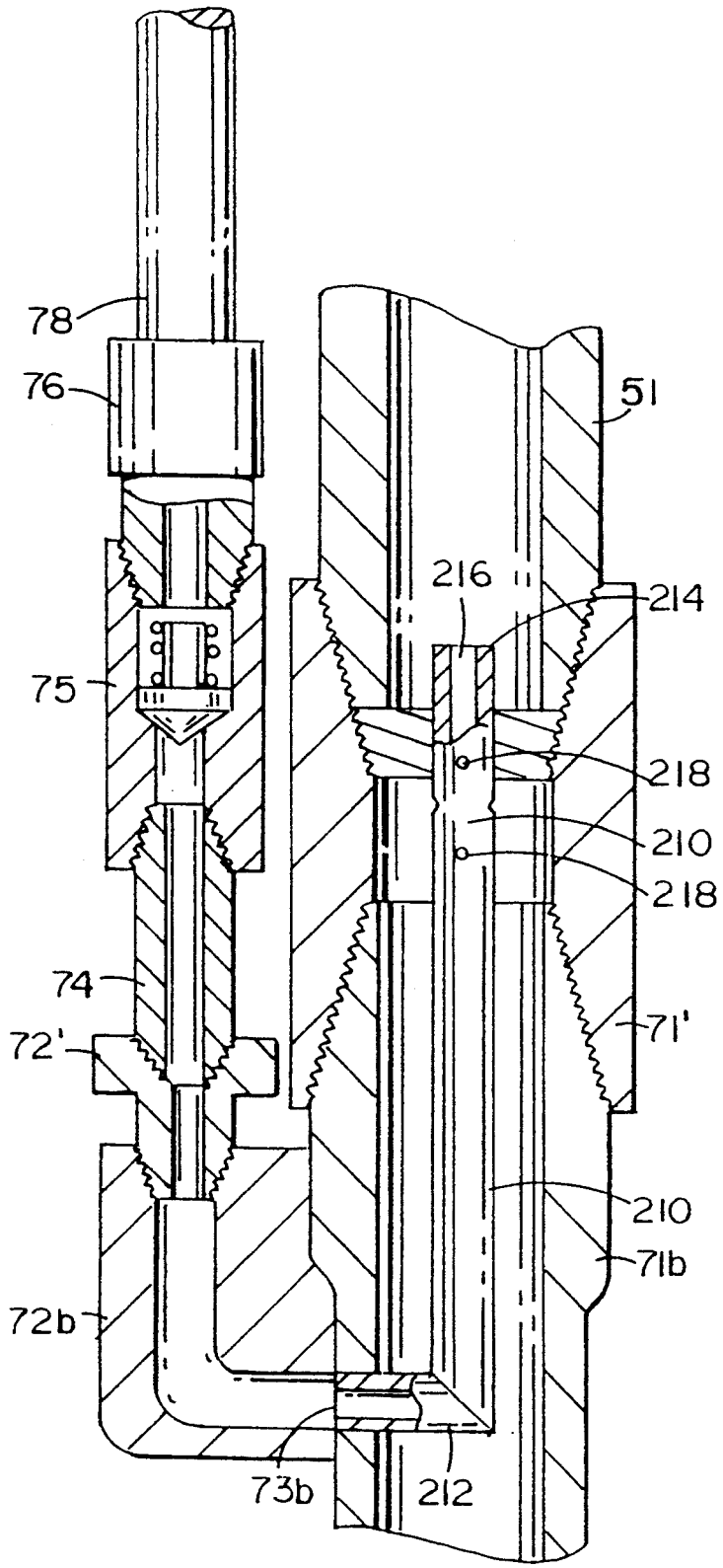
FIG. 6 is a fragmentary section view illustrating yet another alternate embodiment of the injection assembly.

FIG. 6 is a fragmentary section view of yet another embodiment of a portion of injection assembly 70, wherein, like the embodiment shown in FIG. 5, is preferably used in new gas wells to remove water on a continual basis as opposed to periodic injections. Referring to FIG. 6, swage **71*b* and collar 71', similar to that described above in relation to FIG. 5, are used to interconnect lift tube 51 and check valve 68 described above. Disposed within swage 71*b* and oriented along the centerline is a length of one-half inch O.D. stainless-steel tubing 210 having a wall thickness of approximately 0.035 inch. A lower end 212 of tube 210 is oriented 90° thereto and in fluid communication through hole 73*b* with stainless-steel street-L 72*b* welded to the exterior of swage 71*b*. The 90° angle at end 212 of tubing 210** may be formed by mitering and welding two sections of tubing together. It is preferred that the portion of tube 210 extending into hole 73*b* be fixed therein by silver solder or the like. The opposite end 214 of tube 210 terminating along the centerline of swage 71*b* is preferably sealed by a plug 216.

To introduce gas into the interior of swage 71*b*, a plurality of holes 21*b* are drilled completely through tubing 210 at staggered intervals. It is preferred that the sum of the circular areas of the holes equal the circular area of the inside diameter of tubing 210. For example, assuming the outside diameter of tubing 210 is approximately 0.5 inches and the wall thickness is approximately 0.035 inch, the inside diameter (I.D.) is then equal to approximately 0.430 inch. The circular area defined by the I.D. of tubing 210 is then approximately 0.145 square inch. Assuming that two pairs of holes 218 are drilled completely through tubing 210, one 90 degrees to the other, the diameter of each hole would be approximately 0.108 inch. It should be understood that the diameter of the holes perforating tubing 210 is directly dependent upon the number of holes and the inside diameter of tubing 210. It should also be noted that because gas is no longer flowing through a single large diameter hole but through a plurality of much smaller diameter perforations, a slightly higher pressure will be required to force the gas through the perforations in order to obtain the same or similar volume of gas per unit time.

Referring again to FIG. 2, exhaust assembly 90 formed by pipe 92, extending through well head 32, includes valve 120 for completely shutting off the production of water through pipe 92, and a check valve 122 for preventing the discharged water from flowing back down lift tube 50. Pipe 92 is in fluid communication with transmission pipe 34 between valve 118 and check valve 124. Transmission line 34 may also be closed off and sealed from well 10 by valve 126 upstream from check valve 124.

In operation, dewatering assembly 40 is located in bore hole 10 at a desired depth by suspending assembly 40 by tubing 50. It is preferred that assembly 40 be located in well 10 so that injection inlet 72 is located at or below point X in the well where the water level is to be lowered. When located in such a manner, water in the well flows through perforated shield 61 and screen 62 and up through check valve 68. If insufficient water pressure exists to keep valve 68 open, it will close to prevent water from flowing back out.

At intervals determined by a conventional timer located at the surface, pressurized dry gas from source 80 is introduced into tubing 77, 77*a* by valve 102 opened and closed by diaphragm 104 coupled thereto by mechanical linkage 108. Gas from source 80 then passes down injection tube 77 and is introduced through inlet 72 into swage 71 below a column of water contained therein. The volume of gas injected into swage 71 is sufficient to lift the volume of water as a slug up tubing 50. The water slug, propelled, by the expanding volume of gas, is forced through check valve 122 in pipe 92 before being passed into transmission pipe 34. Gas produced from reservoir 16*a* is allowed to flow up bore hole 12 and into pipe 34 controlled by check valve 124. Valve 124 prevents water from pipe 92 from flowing back down pipe 34 and into well 10. The produced gas, injected gas and water all pass through transmission pipe 34 to the storage and production facility.

The primary advantage and purpose served by this device is the ability to turn non-producing gas wells into producing wells without the costs of using expensive positive lift or pumping devices. Moreover, the method and apparatus are less expensive to operate since the gas used to lift the water is contained in a closed loop. The gas from the lift is retained and combined with the gas produced from the well. The net result is typically an early return on the cost of purchasing and installing dewatering assembly 40 in the well. Additional long term benefits are realized as a result of the non-corrosive components, greatly reducing the expense of maintenance and repair.

Operation of the embodiments shown in FIG. 5 work on a similar principle as that described earlier, however, the introduction of gas into the injection assembly is not gauged or controlled by a timer assembly, but flows continuously. In both of these embodiments, the continual flow of gas into lift assembly is believed to create a low pressure and thus continually draw water in through the inlet assembly 60 and up through lift assembly 50. With respect to the embodiment shown in FIG. 6, it is preferred that the perforations 218 extending though tubing 210 distribute the gas injected therethrough radially within swage 71*b* and thus provide a substantially uniform distribution of bubbles therein to lift the water from the well.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A unique method for economically producing natural gas from a well of the type in which gas production has been substantially reduced or ceased because of formation water infiltration into a casing portion of the well, comprising the steps of:

providing a gas transmission line to the well in which pressurized and dried natural gas is transported to the well;

selecting a dewatering conduit shaped to fit within the casing portion of the well, and adapting a lower end thereof for communication with a valve for selectively flowing the formation water into the lower end of the dewatering conduit, and an upper end thereof for communication with a water exhaust line;

positioning the dewatering conduit in the casing portion of the well such that the lower end thereof is submersed in the formation water infiltrated into the casing portion of the well, and the upper end thereof is located near the well surface, the valve including a water inlet disposed operably downstream from a gas inlet;

selectively opening the valve to permit the ground water in the casing portion of the well to flow in a single direction through the water inlet into the lower end of the dewatering conduit to a predetermined elevation to define a slug of water therein;

selectively closing the valve to prevent the slug of water in the lower end of the conduit from escaping therefrom; and communicating said pressurized and dried natural gas in the gas transmission line directly to said gas inlet in the valve through a length of tubing, and thereby injecting a predetermined volume of pressurized natural gas uniformly therein so as to create a low pressure and lift said slug of water contained in said lower end of said dewatering conduit to said water exhaust line.

2. The method of claim 1, wherein the step of communicating said pressurized and dried natural gas directly to said gas inlet occurs at predetermined intervals.

3. The method of claim 2, wherein the interval of communicating said pressurized and dried natural gas directly to said gas inlet is continuous.

4. The method of claim 3, further comprising injecting said predetermined volume of pressurized natural gas uniformly about a centerline of said dewatering conduit.

5. The method of claim 4, wherein the step of injecting said predetermined volume of pressurized natural gas uniformly about a centerline includes injecting said natural gas into said dewatering conduit through a tube disposed along said centerline of said dewatering conduit.

6. The method of claim 2, further including intermittently repeating said valve opening, said valve closing, and said gas injecting steps in sequence to lower the level of the formation water in the well to reduce the hydrostatic pressure exerted by the ground water upon gas producing horizons to a point which enables gas to flow more freely from the horizons into the well.

7. The method of claim 1, wherein permitting the water to flow into said dewatering conduit comprises the steps of filtering the water flowing into said lower end of said dewatering conduit.

8. The method of claim 7, wherein communicating said gas directly to said gas inlet includes:

placing said lower end of said dewatering conduit submersed in the water in direct fluid communication with said gas transmission line through a length of said tubing paralleling said dewatering conduit;

controlling the amount and direction of gas flowing into said tubing by at least one valve in said gas line; and opening and closing said valve in said gas line at periodic intervals determined by a timing mechanism mechanically coupled to said valve.

9. The method of claim 8, further including the steps of preventing water flowing into said dewatering conduit through said lower end from flowing up said length of tubing in fluid communication with said gas line.

10. The method of claim 9, further including the step of preventing water lifted up the dewatering conduit from flowing back down said conduit toward said lower end using at least one check valve disposed along said conduit.

11. The method of claim 9, wherein the interval between closing and opening of said valve in said gas line is less than two minutes.

12. The method of claim 9, wherein the interval said valve is opened is between 5 minutes and 15 minutes.

13. The method of claim 9, wherein positioning said conduit in the well includes suspending said conduit in the well from a well head sealing the well such that said point where the gas is injected into said conduit is substantially at a depth in the well the water level is to be lowered.

14. A novel apparatus for removing formation water from a hydrocarbon-producing well, comprising:

a lift tube shaped to be suspended in the well and having an upper end extending from the top of the well and a lower end located below the water level in the well;

an inlet assembly attached to said lower end of said lift tube and in fluid communication therewith to allow the water to flow in a single direction into said lift tube;

an injection assembly having a lower end disposed in the well, coupled to and in fluid communication with said lift tube proximate said lower end, and an upper end extending from the top of the well;

a source of refined, dried and pressurized natural gas; and means, interconnecting said source of natural gas, in fluid communication with said lower end of said injection assembly, allowing gas from said source into said injection assembly and into said lower end of said lift tube whereby the gas expands below a volume of water in said lift tube and forces the volume of water out the top of the well.

15. The apparatus of claim 14, wherein said injection assembly includes:

a bushing extending into the top of the well and having a first end in fluid communication with said source of natural gas;

a length of flexible tubing having an upper end coupled in fluid communication to an opposite end of said bushing and a lower end disposed in the well proximate said lower end of said lift tube; and a check valve having a first end coupled in fluid communication with said lower end of said flexible tubing and an opposite end coupled in fluid communication with said lower end of said lift tube.

16. The apparatus of claim 15, wherein said injection assembly further includes:

a swage interconnecting said lift tube and said inlet assembly;

means extending through a wall of said swage for interconnecting to said check valve; and a length of tubing extending into said swage from said interconnecting means and disposed along a centerline of said swage, said tubing having at least one opening for placing an interior of said swage in fluid communication with said check valve.

17. The apparatus of claim 16, wherein said inlet assembly includes:

a cylindrical screen threaded at one end and closed at an opposite end;

a cylindrical shield enclosing said cylindrical screen and having at least one hole extending transversely therethrough;

a coupler interconnecting said screen and shield in axial alignment with respect to each other and having a chamfered end; and a check valve interconnecting said chamfered end of said coupler to said lower end of said lift tube.

18. The apparatus of claim 17, wherein said means interconnecting said source of natural gas includes:

means for providing an electrical current;

a timer coupled to said current means; and a valve having a diaphragm in fluid communication with said source of natural gas through said timer and a valve interconnecting said source of natural gas in fluid communication with said injection assembly.

19. A unique apparatus for transforming a gas well capped with a well head and plugged by a column of water into a producing gas well, comprising in combination:

a lift pipe extending from a top of the gas well to a predetermined depth in the well the water is to be lowered;

an injection pipe extending from the top of the gas well to the depth the water is to be lowered and in fluid communication with the lift pipe;

a check valve having one end interconnected to an end of the lift pipe below the injection pipe and disposed in the gas well and submerged in the column of water;

a filter assembly attached to an opposite end of the check valve;

a natural gas supply line located at the top of the gas well;

a bushing extending through the well head placing the gas supply line in fluid communication with the injection pipe;

a gas production line in fluid communication with the gas well and in fluid communication with the lift pipe; and a timer assembly mechanically coupled to the natural gas supply line for opening and closing the supply line at intervals to inject gas in the supply through the injection line and into the end of the lift line disposed in the gas well, whereby water in the gas well and flowing into the lift pipe is transported up the lift pipe and into the gas production line, and reducing the amount of water in the gas well exerting a hydrostatic pressure on at least one gas reservoir exposed therein and allowing gas to be produced therefrom.

20. The apparatus of claim 19, further comprising an injector interconnecting said lift pipe and said check valve, said injector having means disposed along a centerline thereof and in fluid communication with said injection pipe for uniformly introducing a volume of gas into said lift pipe to create a low pressure therein and draw water from the well and lift it to the surface.

21. The apparatus of claim 20, wherein said introducing means is a tube having one end coupled in fluid communication with said injection pipe and an opposite end open in said injector.

22. The apparatus of claim 21, wherein said opposite end of said tube is plugged and said tube contains a plurality of radially distributed perforations extending transversely therethrough.

23. An improved method for dewatering a gas producing well, comprising the steps of:

placing a first end of a conduit in said well below the gas producing zone and submersed in the water and a second end of said conduit coupled to a gas transmission line;

allowing the water in the well to flow into the first end of the conduit in a single direction under hydrostatic pressure; and periodically introducing a volume of natural gas from a source at a surface of the well, through a length of tubing, and into said conduit proximate said first end and below the volume of water which has flowed therein under hydrostatic pressure, said volume of natural gas expanding within and rising in the conduit, forcing the volume of water ahead of it toward said second end and into said transmission line.

24. An improved method for removing water from a gas producing well, comprising the steps of:

locating a conduit in said well wherein a first end is disposed beneath the gas producing zone and immersed in the water, and a second end is located at the surface and in fluid communication with a transmission line;

allowing the water in the well to flow through a filter and into the first end of the conduit under hydrostatic pressure and once within the conduit, preventing the water from exiting the conduit through the first end;

injecting, at periodic intervals, a volume of dried and compressed natural gas through a length of tubing extending from the surface into the conduit proximate the first end below a volume of water which has flowed therein from said well;

expanding said volume of dried compressed natural gas below the volume of water in said conduit, thereby lifting said volume of water in said conduit and out said second end and into said transmission line; and capturing the gas produced by said well and transferring the captured gas to said transmission line.

25. The method of claim 1, further comprising the steps of collecting the gas flowing into the well in a gas transmission pipe;

communicating said predetermined volume of pressurized natural gas and the slug of water with the collected gas and the gas transmission pipe; and transporting the gas produced from the well, the predetermined volume of natural gas, and the water removed from the well to a storage and processing facility.

* * * * *

US005339905A

REEXAMINATION CERTIFICATE (2583rd)

United States Patent [19]

Dowker

[11] B1 5,339,905

[45] Certificate Issued May 16, 1995

[54] GAS INJECTION DEWATERING PROCESS AND APPARATUS

[75] Inventor: Clark A. Dowker, Johannesburg, Mich.

[73] Assignee: Subzone Lift System, Johannesburg, Mich.

Reexamination Request:
No. 90/003,642, Nov. 23, 1994

Reexamination Certificate for:

| | |
|---|---|
| Patent No.: | 5,339,905 |
| Issued: | Aug. 23, 1994 |
| Appl. No.: | 981,503 |
| Filed: | Nov. 25, 1992 |

[51] Int. Cl.[6] ..... E21B 43/12
[52] U.S. Cl. ..... 166/369; 166/324
[58] Field of Search ..... 166/263, 311, 369, 372, 166/373, 374, 324

[56] References Cited

U.S. PATENT DOCUMENTS 971,612 10/1910 Holliday .
1,547,197 7/1925 Arbon .
1,698,619 1/1929 Blow .
1,845,675 2/1932 Martin .
2,814,992 12/1957 Humason .

*Primary Examiner*—Ramon S. Britts

[57] ABSTRACT

An improved method is provided for producing natural gas from wells where gas production has been hampered by the infiltration of water which had heretofore been deemed too expensive to remove when compared to the amount of gas produced from the well. The method includes lowering a conduit from the surface into the well to a depth the water level is to be lowered. Water in the well is allowed to flow into the conduit in a single direction only. A volume of refined natural gas is injected into the conduit below the water contained therein. The injected gas expands within the conduit lifting the volume of water to the surface. Water removed from the well is transported with the injected gas to a storage and processing facility. Lowering of the water level in the well reduces the hydrostatic pressure exerted upon the gas producing horizon to allow gas to flow into the well. Produced gas is transported along with the water and injected gas. This method and an apparatus for use in carrying out the method may also be used in newly drilled gas wells.

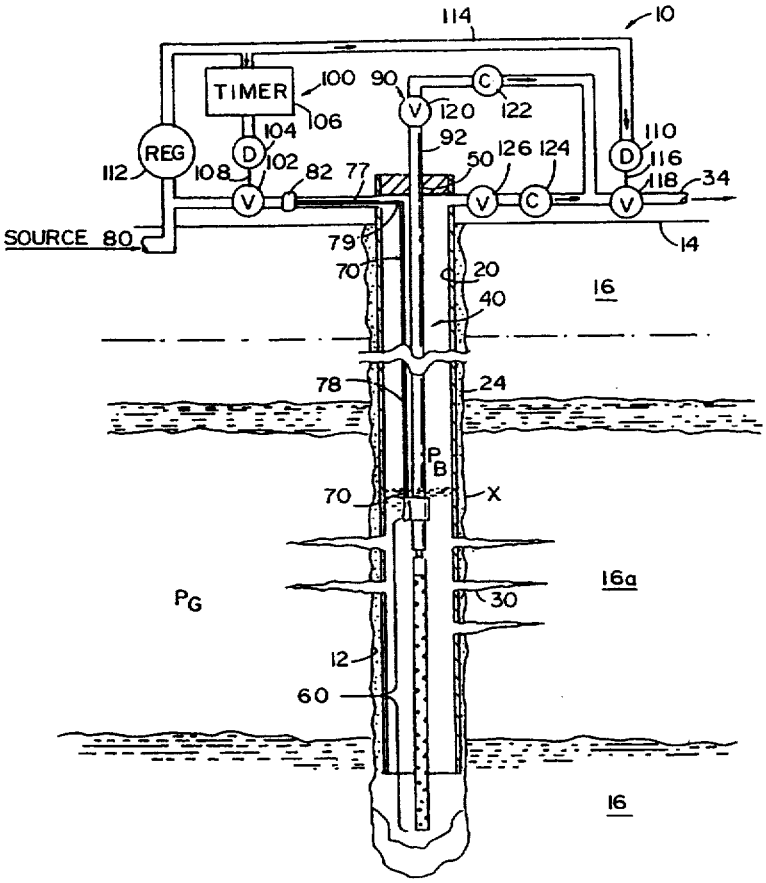

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–25 is confirmed.

* * * * *